United States Patent [19]

Clark et al.

[11] Patent Number: 4,967,662

[45] Date of Patent: Nov. 6, 1990

[54] HIGH SPEED PRINTER WITH INTERPOSER

[75] Inventors: William D. Clark; Ho C. Lee, both of Endicott; John R. O'Toole, Endwell, all of N.Y.

[73] Assignee: International Business Machines Corp., Armonk, N.Y.

[21] Appl. No.: 328,426

[22] Filed: Mar. 23, 1989

[51] Int. Cl.[5] ..... B41J 1/20

[52] U.S. Cl. ..... 101/93.14; 101/93.09; 400/146

[58] Field of Search ..... 400/210, 146; 101/93.01, 93.09, 93.14, 111

[56] References Cited

U.S. PATENT DOCUMENTS

| | | | |
|---|---|---|---|
| 1,181,832 | 5/1916 | Brunn | 400/210 |
| 2,694,481 | 11/1954 | Sharp | 400/210 X |
| 3,312,164 | 4/1967 | Sebring | 101/93 |
| 3,610,140 | 10/1971 | Kondur | 101/93 |
| 4,027,586 | 6/1977 | Hubbard | 101/93.01 |
| 4,762,063 | 8/1988 | Yeagle | 101/93.01 |
| 4,764,039 | 8/1988 | Bublitz | 101/93.14 X |

OTHER PUBLICATIONS

IBM Tech. Disc. Bulletin, vol. 17, No. 5, Oct. 1974, p. 1320, "Label Printer", R. L. Gilbert.

IBM Tech. Disc. Bulletin, vol. 23, No. 10, Mar. 1981, p. 4739, "Bar-Half Bar Code Pattern", A. H. Ett.

IBM Tech. Disc. Bulletin, vol. 27, No. 7A, Dec. 1984, p. 3897, "Wear Prevention for Print Hammers", R. G. Bayer.

*Primary Examiner*—Clifford D. Crowder

*Attorney, Agent, or Firm*—John S. Gasper

[57] ABSTRACT

High speed impact line printers comprise a continuously moving type carrier, such as an endless belt or band having engraved type characters movable at constant speed parallel to a row of print hammers. A print medium such as a continuous paper web and an ink ribbon are located between the hammers and the type carrier. The hammers are uniformly spaced parallel with the type carrier to define a print line. The spacing of the hammers corresponds to the desired spacing of the printed characters when printed and generally has one print hammer for each print position. An interposer member located between the print hammers and the print paper web enables certain characters such as vertical or horizontal bars of bar code type can be printed in the region of the clearance gaps between hammers. The interposer member can be either a thin, flexible strip or sheet of elastomeric material such as polyimide which spans a plurality of the hammers or a comblike metal member having individual flexure finger elements aligned with the print hammers. The finger elements are mutually separated by a gap which can be much narrower than the clearance gaps between the hammers.

14 Claims, 7 Drawing Sheets

HIGH SPEED PRINTER WITH INTERPOSER

FIELD OF THE INVENTION

This invention relates to high speed line printers and particularly to printers for printing bar code.

BACKGROUND OF THE INVENTION

High speed impact line printers comprise a continuously moving type carrier such as an endless belt or band having engraved type characters movable at constant speed parallel to a row of print hammers. A print medium such as a continuous paper web and ink ribbon are located between the hammers and the type carrier. The print hammers are uniformly spaced parallel with type carrier to define a print line. The spacing of the hammers corresponds to the desired spacing of the printed characters when printed and generally has one print hammer for each print position. In some applications, the number of print hammers may be fewer than the number of print positions and the hammers could span more than one print position between hammers. In either case, the hammers are separated by an interhammer clearance gap and characters are printed by the hammers at predetermined positions. As the print force is confined within the width of the hammers, printing cannot be made at the gaps between the hammers. This limits band printers from use in applications such as bar code printing where it may be desirable to produce imprints within the region of the interhammer gaps. The problem is due to the fact that the print force is essentially confined within the boundaries determined by the hammer structure whereas the code patterns include portions which must occur within the region of the interhammer clearance gaps.

A particular instance in which the problem occurs is when vertical bar code, such as UPC, is to be printed. Vertical bar code patterns comprise combinations of horizontally spaced vertical bars of different widths separated by spaces of different widths. The combination of thick and thin bars with thick or thin spaces forms the code by which the data characters are recognized by a bar code reader. There is no problem in printing vertical bar code when the bar imprints are within the boundaries of the hammer as in the case of printing alphanumeric characters. However, the bar code formats currently in use require bar imprints to be formed to some extent in the region of the interhammer clearance gap. In those instances, the bar must be impacted when located outside the normal boundaries of the hammers. This produces an incomplete bar imprint which affects the dimensions of the bar code imprint which can produce errors in detection and decoding by the scanner devices which read the code. The problem also occurs when printing horizontal bar code with horizontal bars vertically spaced where the type element is wider than the boundary of the hammers and gaps are formed in the horizontal bar imprint.

Printing vertical bar code with a high speed impact line printer is known. U.S Pat. Nos. 4,027,586 and 4,762,063 show printing vertical bar code using a type carrier which is a rotating drum. An article of R. L. Gilbert published in the IBM Technical Disclosure Bulletin, Vol. 17, No. 5, pp. 1320 et seq. also shows vertical bar code printing using a drum printer. An article of A. H. Ett published in the IBM Technical Disclosure Bulletin, March 1981, Vol. 23, No. 10, pp. 4739 et seq. shows a bar code design which avoids the problem of closely spaced bar imprints caused by variation in the flight time of the print hammers of a chain or train printer. None of this art deals with the problem of printing bar code at locations within the interhammer clearance gaps of the print hammers.

SUMMARY OF THE INVENTION

It is an object of this invention to provide an improved high speed impact line printer for printing variously arranged print patterns.

It is a specific object to provide an improved high speed line printer for printing bar code patterns.

It is a further specific object of this invention to provide a high speed impact line printer in which printing of the bar code imprints can be formed at locations within the interhammer gaps of the printer.

Basically the above as well as other objects are obtained by providing means for expanding the area or zone of impact of the print hammers. Specifically the means for expanding the impact zones of the hammers comprises an interposer member positioned between the row of print hammers and the print medium. In the preferred form, the interposer member comprises a thin, flexible but relatively rigid, compared to the print medium, sheet or strip of elastomeric material which spans both the impact zones of individual hammers and bridges the gaps between adjacent print hammers. Preferably the material is a polymer and the sheet or strip spans the entire row of print hammers to thereby bridge the interhammer gaps. The interposer sheet can be polyethylene teraphthalate but preferably is a polyimide such as Kapton material sold by duPont. In another form, the interposer member is a comb having a plurality of flexible interposer elements positioned between individual hammers and the print medium. The interposer fingers have a width greater than the width of the individual hammers so that the edges of the fingers extend beyond the edges of the hammer into the adjacent hammer gaps.

Interposers have been used in impact printers for various reasons. U.S. Pat. No 3,312,164 shows a print apparatus which prints on a multiple layer print medium. A shield consisting of multiple layers of plastic is located between the print hammers and the print medium to sustain the direct force of the hammer blow delivered to the print medium. The purpose of the shield is to eliminate the production of a halo or shadow image bordering the characters recorded on the print medium.

U.S. Pat. No. 3,610,140 shows a print apparatus having a rotating drum with engraved characters on the surface thereof and a row of print hammers with a paper web therebetween. A thin tape of low coefficient of friction material is interposed between the drum and the paper. The purpose of the tape is to attenuate high frequency noise and induced vibrations normally generated by the frictional contact between the web and the moving characters.

An article of R. G. Bayer et al published in the IBM Technical Disclosure Bulletin for December 1984, Vol. 27, No. 7A, p. 3897 shows a thin strip of plastic material interposed between a row of print hammers and an engraved type band. The tape is made of low friction material. The purpose of the tape is to prevent wear of the faces of the print hammers resulting from the lateral motion of paper induced by the moving type band.

None of this prior art relates to printing bar code patterns which include bars printed in the region of the interhammer gaps of the printers.

BRIEF DESCRIPTION OF THE DRAWINGS

The foregoing and other objects, features and advantages of the invention will be apparent from the following more particular description of preferred embodiments of the invention, as illustrated in the accompanying drawings.

DETAILED DESCRIPTION OF THE INVENTION

Figure 6:
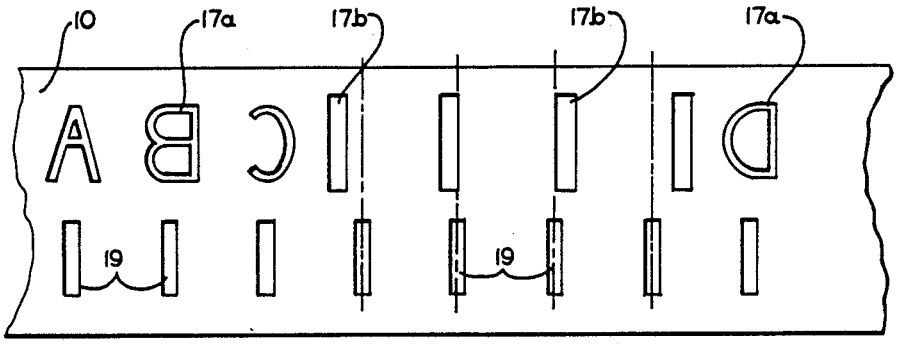
FIG. 6 is a plan view of a segment of an engraved type band which showing an arrangement of bar elements with alphanumeric characters for printing vertical bar code in accordance with the invention.
Figure 7:
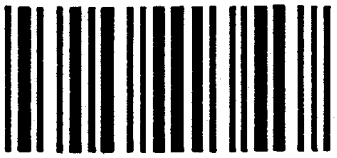
FIG. 7 shows one type of bar code pattern printable on a high speed printer in accordance with the invention.

The printer mechanism, as shown in the figures, comprises a continuous type band 10, platen 11, ink ribbon 12, web 13 and electromagnetically operated print hammers 14 mounted on frame element 31 and arranged in a row parallel with the straight portion of type band 10. Type band 10 is supported by a pair of drive pulleys 15 and 16. A drive motor (not shown) connected to either drive pulley operates to move type band 10 at constant speed during the printing operation. Type band 10, in one form in which this invention is practiced, has engraved type elements 17, which as seen more clearly in FIGS. 2 and 6 comprise alphabetic type elements 17*a* and vertical bar code type elements 17*b* arranged in a single row around the outer surface of band 10. Band 10 might also have numeric type elements and horizontal bars for printing horizontal bar code. Band 10 has a row of timing marks 19 which are sensed by transducer 20, which with timing circuit 21, generates print scan pulses to hammer control 22 and printer control 23 which selectively operate print hammers 14 in timed relation with the motion of type 17 and 18 on band 10. Timing marks 19 are uniformly spaced around the band 10. Alphabetic type elements 17*a* are typically aligned with the timing marks 19. The bar code type elements 17*b* are aligned with or offset either to the right or left of the timing marks 19 as seen in FIG. 6. This enables the vertical bar code type 17*b* to be aligned for impact at different positions within and outside the impact areas of the print hammers 14. Bar code type elements may be of different thicknesses although only a single thickness is illustrated for simplicity, for the purpose of printing thick and thin bar code patterns as shown in FIG. 7. In the case of horizontal bar code, horizontal bar type elements (not shown) are formed on band 10 in which case the horizontal length of the horizontal bar type element is wider than the width of the hammer thereby in accordance with this invention permitting printing the bar imprints with overlap.

Print hammers 14 are arranged facing type 17*a* and 17*b* with paper web 13 and ink ribbon 12 therebetween. Web 13 may comprise a substrate on which merchandise labels (not shown) are removably attached for the purpose of printing either alphanumeric or bar code imprints or both. Web 13 is fed in line increments by tractors 24 of any well known type (see FIG. 2) driven by motor 25 in response to motor drive signals supplied by print control 23. Ink ribbon 12 extends between spools 26 and 27 connected to drive means (not shown) for advancing ribbon 12 in alternate directions.

Figure 1:
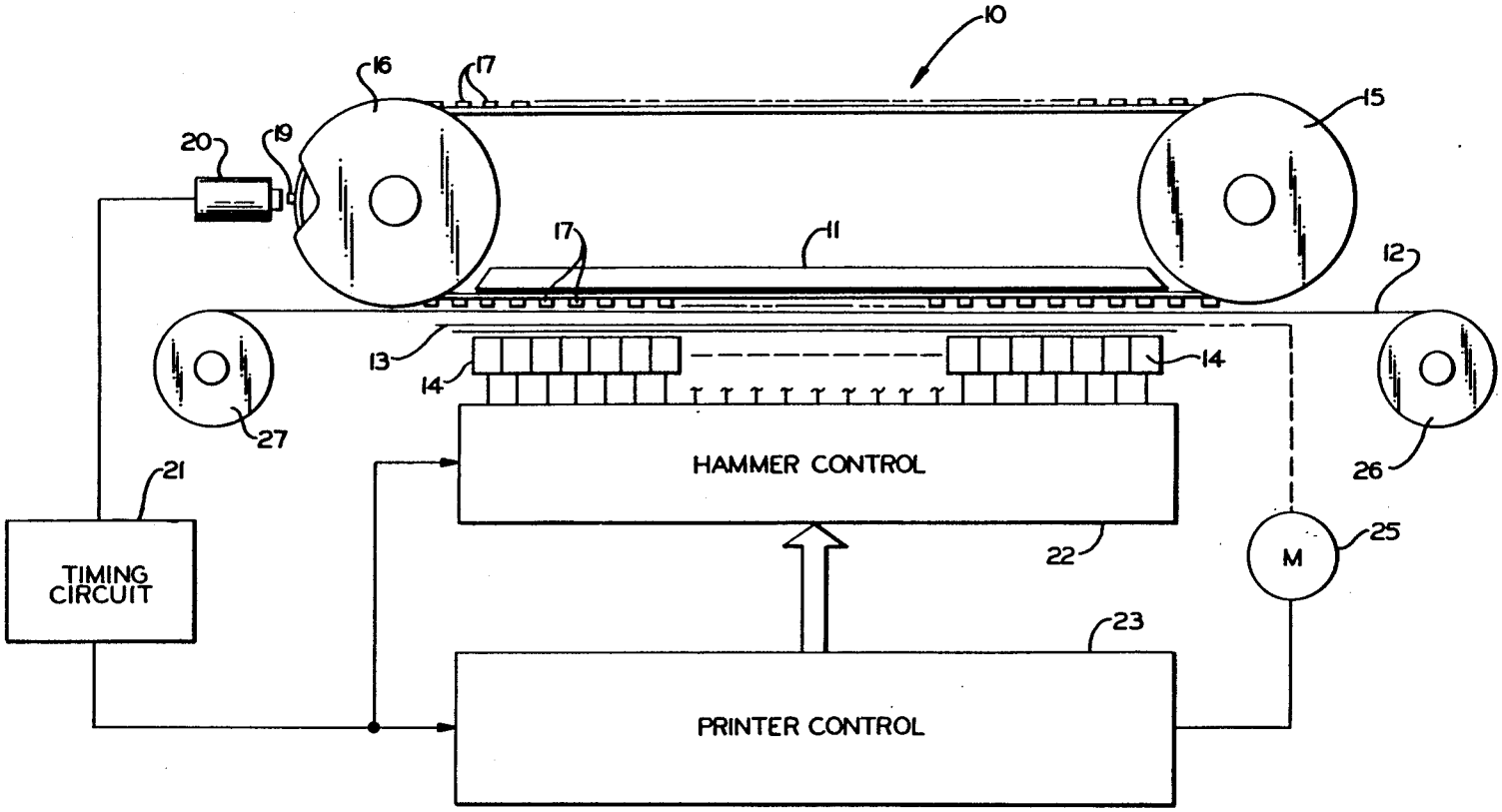
FIG. 1 is a schematic of a high speed printer apparatus showing the a printer system for practicing the invention.
Figure 2:
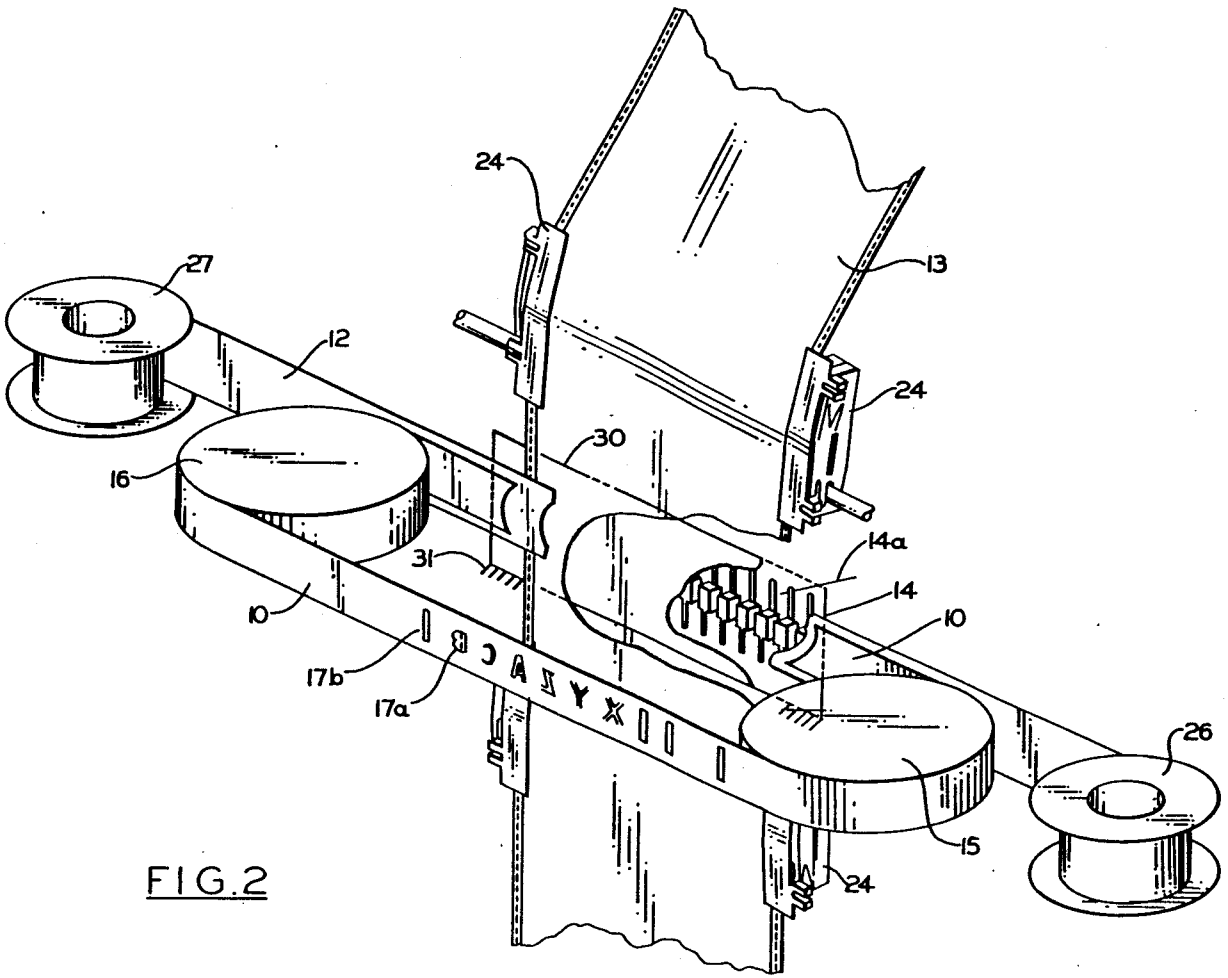
FIG. 2 is a three dimensional view of a portion of a printer mechanism of FIG. 1 in which the invention is used.
Figure 3:
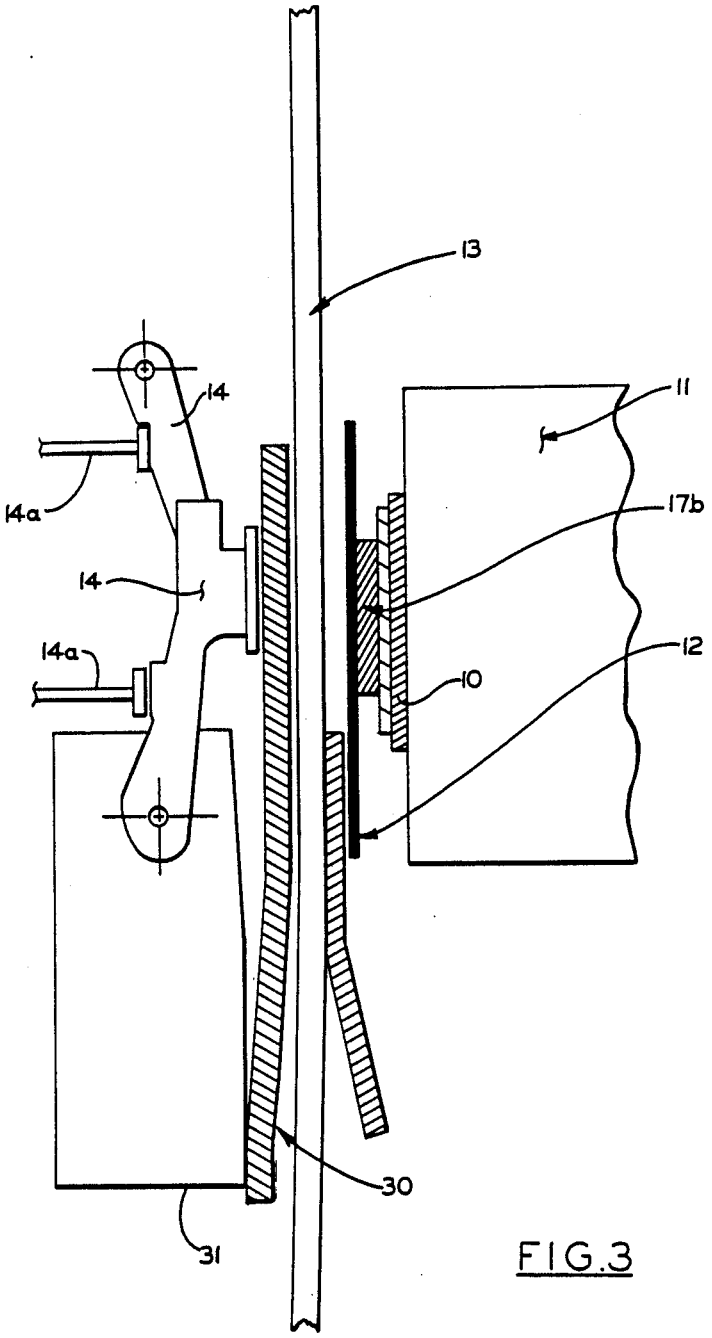
FIG. 3 is a side view of the printer mechanism of FIG. 2.
Figure 4:
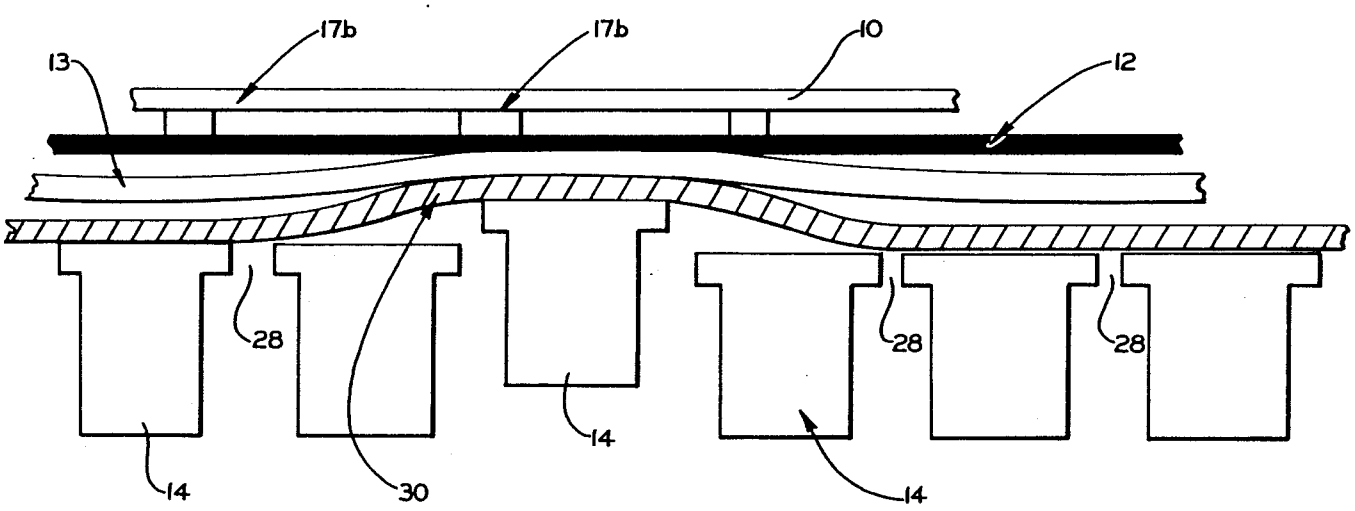
FIG. 4 is a top plan view of a portion of the printer mechanism of FIG. 2.

Print hammers 14 are uniformly spaced over the distance which represents the length of the print line of web 13. The number of print positions can vary and is typically 132 per print line. The number of print hammers 14 can vary depending on the span of the individual hammers. For example, as seen in FIG. 2, there can be a print hammer for each print position or the print hammer may have a span of two or more print positions. In any event, the pitch of the type on band 10 is typically different from the pitch of the print hammers 14. Consequently during the revolution of band 10, as is well known, subgroups of type 17*a* and 17*b* align with subgroups of print hammers 14 across the print line in subscan sequences. Print control 23 and hammer control 22 operate hammers 14 in accordance with the subscan sequence alignments. Such controls are well known in the art.

Figure 5:
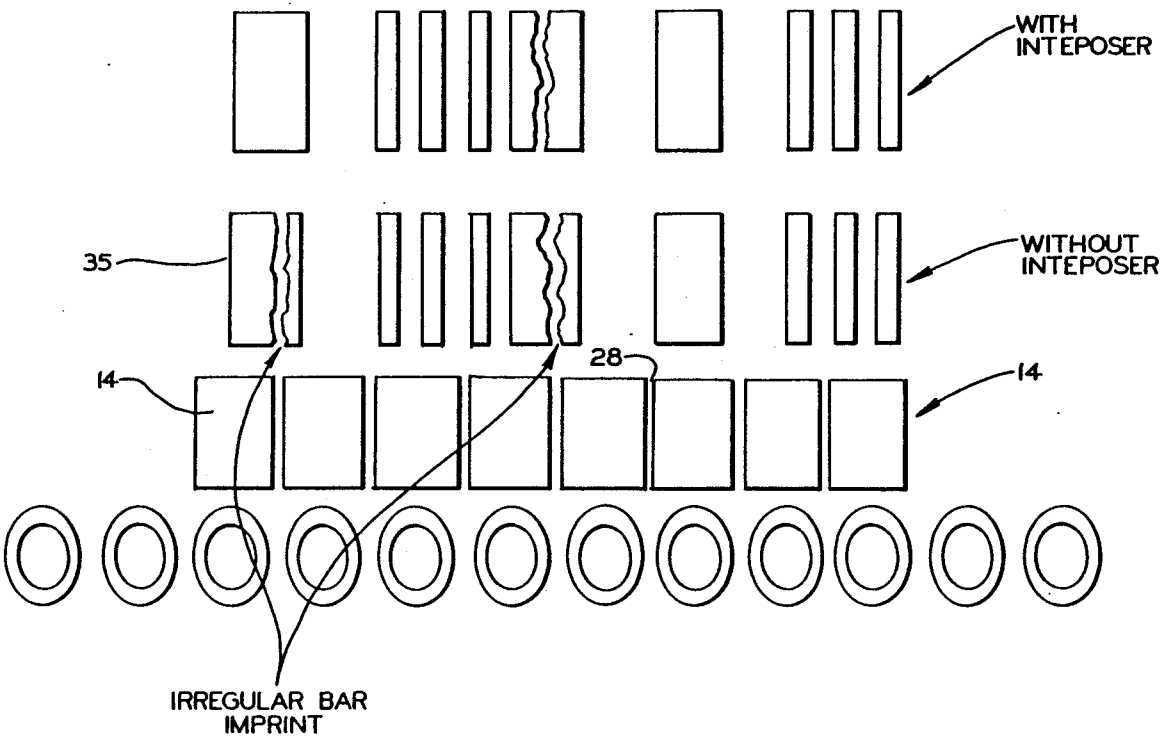
FIG. 5 is a schematic showing partial samples of vertical bar code pattern which illustrate printing with and without the use of the invention.

Hammers 14 are separated by interhammer clearance gaps 28 (see FIG. 5) which enable the hammers to move individually without interference. While they can be made relatively small, gaps 28 within normal tolerance ranges up to 0.016 inches, are too large to print a sharp bar imprint wholly or partly within the gaps 28. To some extent, a bar imprint can be formed within the gaps 28 if the paper and ink matrix is soft enough and relying on ink bleeding. However, print quality suffers and bar code imprints 35 (see FIG. 5) are not sharp enough to produce accurate signals when read by scanner means.

As seen in FIGS. 1–5, an interposer member is positioned between hammers 14 and web 13. In one embodiment of this invention, the interposer member is a thin sheet 30 extending across the entire print line. Sheet 30 is preferably plastic and is preferably a polymer material. The plastic can be polyethylene teraphthalate but best results are obtained with sheet made of a polyimide material such as Kapton sold by duPont. Sheet 30 is is a single layer and is thin enough to be flexible but is relatively stiff compared to the web 13 and ink ribbon 12. One such interposer member is a single layer Kapton sheet having a thickness of 3 to 5 mils. When impacted by hammers 14, sheet 30 acts as a flexural beam whereby its flexural rigidity provides support to the web 13 across the width of the hammer and beyond thereby extending the impact area of the hammers 14 to include the region of interhammer gaps 28.

Figure 8:
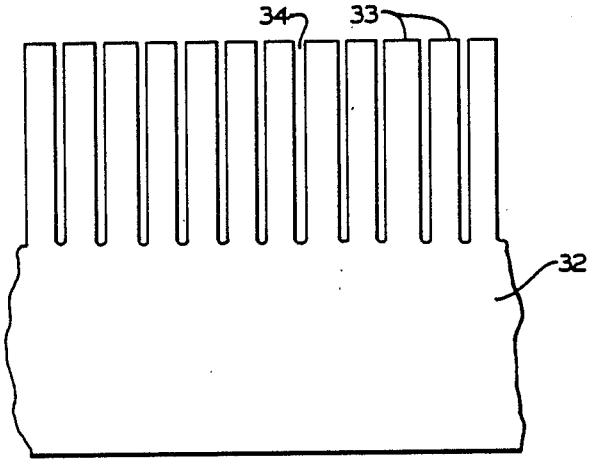
FIG. 8 shows an interposer in the form of a comb.

In the embodiment of FIG. 8, the interposer member takes the form of a comb 32 having individual interposer elements or flexible fingers 33 separated by gaps 34. Interposer elements 33 are aligned with and are wider than hammer elements 14. The gaps 34 are much narrower than the interhammer gaps 28 which can be wider than with sheet 30. Comb 32 is preferably metal and preferably is made of a thin piece of spring steel. The suitable thickness range for comb 32 is 7 to 15 mils.

Thus it will be seen that a high speed line printer has been provided which is capable of printing patterns such as bar code patterns where the element of the pattern are formed with type elements when aligned outside the width of the hammer in the region of the interhammer gaps.

While the invention has been particularly shown and described with reference to preferred embodiments thereof, it will be understood by those skilled in the art that various change in form and details may be made therein without departing from the spirit and scope of the invention as stated in the following claims.

We claim:

1. A printing apparatus having a type carrier operable for moving type elements along a print line of a document, a plurality of print hammers with impact surfaces uniformly spaced and arranged in a row parallel with said print line and operable to impact said document against said type elements to produce imprint patterns along said print line, said impact surfaces of said hammers being aligned with individual print positions of said print line and having lateral edges separated by clearance gaps, and means interposed between said document and said impact surfaces of said print hammers for enlarging the impact area of said impact surfaces of said print hammers to include said clearance gaps whereby said interposer causes complete imprints of said type elements to be formed on said document when said hammers are operated and at least a portion of said type elements as a result of movement of said carrier is aligned with said clearance gaps.

2. A printing apparatus according to claim 1 wherein said interposed means spans a plurality of said impact surfaces and said clearance gaps.

3. A printing apparatus according to claim 2 wherein said interposed means comprises a thin flexible sheet of elastomeric material spanning the entire length of said print line.

4. A printing apparatus according to claim 3 wherein said elastomeric material is polyethylene teraphthalate.

5. A printing apparatus according to claims 3 wherein said elastomeric material is a polyimide.

6. A printing apparatus according to claim 5 wherein said polyimide material comprises a single layer sheet having a thickness in the range of 0.003 to 0.005 inches.

7. A printing apparatus according to claim 1 wherein said type elements having said portions aligned with said clearance gaps are bars and said imprint patterns comprise a plurality of bar code imprints arranged to form a bar code pattern along said print line.

8. A printing apparatus according to claim 7 wherein said bars having said portions aligned with said clearance gaps are vertical bar elements of different thicknesses and said bar code pattern comprises a plurality of vertical bar code imprints of different thicknesses arranged along said print line.

9. A printing apparatus according to claim 7 wherein said bars having portions aligned with said clearance gaps are horizontal bar elements having end portions alignable with said clearance gaps and arranged to form a horizontal bar code pattern along said print line.

10. A printing apparatus according to claim 7 wherein said type carrier comprises a continuous type band having timing marks uniformly spaced along said band for timing the location of said type relative to said print positions of said print line, and said bars include vertical bar elements formed on said band so as to be laterally offset from said timing marks to as to be impacted outside the edge of said impact surfaces of said print hammers during impact with said document.

11. A printing apparatus according to claim 1 wherein said interposed means comprises a plurality of interposer elements individually aligned with individual hammers, said interposer elements have a width greater than the width of said hammers, and said individual interposer elements being separated by spaces aligned with but narrower than said clearance gaps.

12. A printing apparatus according to claim 11 having a type carrier operable for moving type elements along a print line of a document, a plurality of print hammers with impact surfaces uniformly spaced and arranged in a row parallel with said print line and operable to impact said document against said type elements to produce imprint patterns along said print line, said impact surfaces of said hammers being aligned with individual print positions of said print line and having lateral edges separated by clearance gaps, and means interposed between said document and said impact surfaces of said print hammers for enlarging the impact area of said impact surfaces of said print hammers to include said clearance gaps whereby imprints of said type elements are formable on said document when at least a portion of said type elements is aligned with said clearance gaps, said interposed means comprising a plurality of interposer elements individually aligned with individual hammers, said interposer elements having a width greater than the width of said hammers, and said individual interposer elements being separated by spaces aligned with but narrower than said clearance gaps, and wherein said interposed means comprises a comb member and said individual interposer elements comprise flexible fingers extending from a bar portion of said comb member.

13. A printing apparatus according to claim 12 wherein said comb member is a single piece of thin flexible metal.

14. A printing apparatus according to claim 13 wherein said metal is stainless steel.

* * * * *